US007789061B2

(12) United States Patent
Ishimitsu

(10) Patent No.: US 7,789,061 B2
(45) Date of Patent: Sep. 7, 2010

(54) ENGINE OUTPUT TAKEOUT DEVICE

(75) Inventor: Kengo Ishimitsu, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 281 days.

(21) Appl. No.: 12/103,865

(22) Filed: Apr. 16, 2008

(65) Prior Publication Data

US 2008/0257299 A1 Oct. 23, 2008

(30) Foreign Application Priority Data

Apr. 20, 2007 (JP) ..... P2007-111619

(51) Int. Cl.
*F02B 75/32* (2006.01)

(52) U.S. Cl. ..... 123/197.1; 123/53.2; 123/59.6; 74/665 E

(58) Field of Classification Search ..... 123/52.4, 123/52.6, 53.2, 59.6, 197.1, 197.4; 74/665 A, 74/665 B, 665 D, 665 E
See application file for complete search history.

(56) References Cited

U.S. PATENT DOCUMENTS 2,504,988 A * 4/1950 Kronlund ..... 74/665 D
5,682,844 A 11/1997 Wittner
7,475,667 B2 * 1/2009 Al-Bannai ..... 123/197.4
2005/0274332 A1 12/2005 Lemke et al.

* cited by examiner

*Primary Examiner*—Noah Kamen
(74) *Attorney, Agent, or Firm*—Birch, Stewart, Kolasch & Birch, LLP

(57) ABSTRACT

Engine output takeout device includes: a first crank gear mounted on a first crankshaft; a second crank gear mounted on a second crankshaft; a ring gear surrounding the first and second crank gears and having inner teeth meshing with the first crank gear; and an idler gear rotatably mounted coaxially on the first crankshaft via bearings and meshing at its one position with the second crank gear and at its other position with the inner teeth of the ring gear, the first crank gear and the idler gear both meshing with a same inner tooth of the ring gear at any given time.

1 Claim, 11 Drawing Sheets

ENGINE OUTPUT TAKEOUT DEVICE

FIELD OF THE INVENTION

The present invention relates to engine output takeout devices for taking out output of an engine having two crankshafts.

BACKGROUND OF THE INVENTION

Parallel-crank type engines have been proposed where two connecting rods are connected to a piston and to respective crankshafts disposed in parallel to each other so that output of the engine can be taken out from the two crankshafts. Devices for taking out engine output from such two crankshafts have been known, such as one where crank gears mounted on the two crankshafts are intermeshed so as to take out engine output from one of the crank gears (e.g., U.S. Pat. No. 5,682,844 which will hereinafter be referred to as Patent Literature 1) and one where engine output is taken out from the two crankshafts via a plurality of gears (e.g., U.S. Patent Application Publication No. 2005/0274332 A1 which will hereinafter be referred to as Patent Literature 2).

FIG. 8 is a partly-sectional side view of the engine output takeout device disclosed in Patent Literature 1. This engine output takeout device 200 includes gears 203 and 204 mounted on two crankshafts 201 and 202, respectively, and a shaft 205 connected to one of the gears 203 to take engine output outside the engine output takeout device. The crankshafts 201 and 202 are connected to a piston 211 via respective connecting rods 207 and 208.

FIG. 9 is a partly-sectional side view of the engine output takeout device disclosed in Patent Literature 2. This engine output takeout device 220 includes: an inner gear 222 mounted on one of crankshafts 221; a ring-shaped output gear 224 having inner teeth 223 meshing the inner gear 222; an output shaft 225 having the output gear 224 mounted thereon; and a gear 228 mounted on the other crankshaft 226 and meshing with outer teeth 227 of the output gear 224.

FIG. 10 is a view explanatory of behavior of the engine output takeout device 200 of FIG. 8, where (a), (c) and (e) schematically show the device 200. (a) of FIG. 10 shows a state in an engine expansion stroke where a lower surface 203*b* of a tooth 203*a* of the gear 203, to which the shaft 205 (see (a)) is connected to takeout engine output, contacts an upper surface 204*b* of a tooth 204*a* of the gear 204 as shown in (b) of FIG. 10. This is because the gear 203 has a greater moment of inertia than the gear 204 due to a connection with the outside for taking out engine output and thus is more difficult to rotate than the gear 204; in other words, the gear 204 functions as a driving gear, while the gear 203 functions as a driven gear.

(c) of FIG. 10 shows a state in an engine compression stroke where an upper surface 203*d* of a tooth 203*c* of the gear 203 contacts a lower surface 204*c* of a tooth 204*a* of the gear 204 as shown in (d) of FIG. 10. This is because the gear 203 has a greater moment of inertia than the gear 204 and thus is more difficult to stop rotating than the gear 204; in other words, the gear 203 functions as a driving gear, while the gear 204 functions as a driven gear.

Namely, the gears 203 and 204 alternately function as the driving and driven gears during operation of the engine, and thus, the piston 211 connected to the gears 203 and 204 via the connecting rods 207 and 208 would incline within a cylinder, as shown in (e) of FIG. 10, due to a gap or backlash between the tooth surfaces of the teeth 203*a*, 203*b* and the tooth 204*a*, i.e. a difference in rotational angle between the gears 203 and 204 produced by a backlash. Such inclination of the piston 211 would lead to generation of slap sound and abrasive wear of the piston and cylinder liner.

FIG. 11 is a view explanatory of behavior of the engine output takeout device 220 of FIG. 9, where (a) and (d) schematically show the takeout device 200 including connecting rods 231 and 232 and piston 233 in addition to the crankshafts etc. (a) of FIG. 11 shows an engine expansion stroke where an upper surface 223*b* of an inner tooth 223*a* of the output gear 224 contacts a lower surface 222*b* of a tooth 222*a* of the inner gear 222 as shown in (b) of FIG. 11. This is because the inner gear 222 has a smaller moment of inertia than the output gear 224 and thus is easier to rotate than the output gear 224; in other words, the inner gear 222 functions as a driving gear, while the output gear 224 functions as a driven gear.

Further, an upper surface 228*b* of a tooth 228*a* of the gear 228 contacts a lower surface 227*b* of an outer tooth 227*a* of the output gear 224 as shown in (c) of FIG. 11. This is because the gear 228 has a smaller moment of inertia than the output gear 224 and thus is easier to rotate than the output gear 224; in other words, the gear 228 functions as a driving gear, while the output gear 224 functions as a driven gear.

(d) of FIG. 11 shows a state of an engine compression stroke where a lower surface 223*b* of an inner tooth 223*d* of the output gear 224 contacts an upper surface 222*c* of a tooth 222*a* of the inner gear 222 as shown in (e) of FIG. 11. This is because the output gear 224 has a greater moment of inertia than the inner gear 222 and thus is more difficult to stop rotating than the inner gear 222; in other words, the output gear 224 functions as a driving gear, while the inner gear 222 functions as a driven gear.

Further, a lower surface 228*c* of a tooth 228*a* of the gear 228 contacts an upper surface 227*d* of an outer tooth 227*c* of the output gear 224 as shown in (f) of FIG. 11. This is because the output gear 224 has a greater moment of inertia than the gear 228 and thus is more difficult to stop rotating than the gear 228; in other words, the output gear 224 functions as a driving gear, while the gear 228 functions as a driven gear.

Namely, during the operation of the engine, as shown in (a)-(f) of FIG. 11, the tooth 222*a* of the inner gear 222 and tooth 228*a* of the gear 228 contact the tooth surfaces of the inner teeth 223 and outer teeth 227 of the output gear 224 in the same rotational direction in each of the expansion and compression strokes, and thus, there occurs no rotational angle difference between the inner gear 222 and the gear 228. Namely, the inner gear 222 and gear 228 rotate in constant synchronism with each other, and thus, the piston 233 connected to the crankshafts 221 and 226 via the connecting rods 231 and 232 would not incline.

However, during high-speed rotation and high-load operation or under the influence of torque fluctuation, there is a possibility of the output gear 224 undesirably deforming from a circular shape into a non-circular shape. If different deformations occur at positions of meshing between the inner teeth 223 of the output gear 224 and the inner gear 222 and between the outer teeth 227 of the output gear 224 and the gear 228, the synchronism between the inner gear 222 and the gear 228 would be lost, which results in unwanted inclination of the piston 233.

Further, the tip diameter and pitch diameter of the output gear 224 are determined by the inner gear 223 and gear 228, and thus, when the speed reduction ratio between the inner gear 222 and gear 228 and the output gear 224 is to be changed, there is no other choice but to change the modules of the individual gears, in which case abrasive wear of the tooth surfaces would increase.

Furthermore, because it is difficult to increase the tip diameter and pitch diameter of the output gear 224, the output gear 224 has a small moment of inertia, and thus, the engine output takeout device 220 requires a flywheel in order to reduce rotational fluctuation. As a consequence, the number of necessary components increases, which results in a cost increase. If the diameter of the output gear 224 is increased with the distance between the two crankshafts 221 and 226 increased, the overall size of the engine output takeout device 220 would also increase because the output gear 224 and gear 288 project outwardly beyond the distance between the two crankshafts 221 and 226.

SUMMARY OF THE INVENTION

In view of the foregoing prior art problems, it is an object of the present invention to provide an improved engine output takeout device which can reduce abrasive wear of the tooth surfaces of individual crank gears, mounted on respective crankshafts, while maintaining synchronism between the crank gears even during high-speed and high-load rotation of the crank gears, and which can also be of a reduced size.

In order to accomplish the above-mentioned object, the present invention provides an improved engine output takeout device for taking out engine output from first and second crankshafts disposed in parallel to each other in an engine, which comprises: a first crank gear mounted on the first crankshaft; a second crank gear mounted on the second crankshaft; a ring gear disposed around the first and second crank gears and having inner teeth meshing with the first crank gear; and an idler gear rotatably mounted coaxially on the first crankshaft via a bearing and meshing at one position thereof with the second crank gear and at another position thereof with the inner teeth of the ring gear, the first crank gear and the idler gear both meshing with a same inner tooth of the ring gear at any given time.

With the first crank gear and the idler gear meshing with a same inner tooth of the ring gear at any given time, there can constantly be achieved synchronism between the rotation of the first crank gear and the rotation of the idler gear even when deformation occurs in the ring gear during high-speed rotation and high-load operation of the first and second crankshafts.

Further, because the ring gear meshes at its inner tooth with the first crank gear and idler gear, the present invention can increase the diameter of the ring gear and thus increase the moment of inertia of the ring gear, which can eliminate the need for provision of a flywheel that prevents rotational fluctuation.

Further, the tip diameter of the inner teeth of the ring gear can be reduced within a particular range as long as the first crank gear and idler gear can be disposed inside the ring gear, and thus, the engine output takeout device of the present invention can be reduced in size.

Furthermore, with the first crank gear and idler gear meshing with the same inner tooth of the ring gear, there can constantly be achieved rotation synchronism between the first crank gear and the idler gear (i.e., between the first and second crank gears) even when deformation or flower pedal oscillation (i.e., oscillation accompanied by deformation of a flower pedal shape) occurs in the ring gear during high-load operation and high-speed rotation of the crank gears. As a result, the present invention can reliably prevent unwanted inclination of a piston and thus can minimize generation of slap sound and abrasive wear of the piston and cylinder.

Furthermore, with the first crank gear, second crank gear and idler gear disposed inside the ring gear, the ring gear can be set to a diameter greater than that in the conventionally-known engine output takeout devices. Therefore, even when the speed reduction ratio is to be increased, the modules of the individual gears do not have to be increased, so that an increase in abrasive wear can be prevented. Furthermore, because the moment of inertia of the ring gear can be increased, the present invention can eliminate the need for provision of a flywheel and thereby reduce the number of necessary component parts and hence the necessary cost of the engine output takeout device. Furthermore, if the size of the ring gear is increased, the present invention can reduce the tooth surface load and thereby reduce the face width of the ring gear so that the weight of the ring gear can be reduced.

Besides, because the diameter of the ring gear can be reduced within a particular range as long as the first crank gear, second crank gear and idler gear can be disposed inside the ring gear, the engine output takeout device of the invention can be reduced in size.

Furthermore, the present invention can also maintain the synchronism between the first and second crank gears by causing these gears to mesh with the same teeth of the ring gear, rather than by increasing the rigidity of the ring gear, in this way, the weight of the ring gear can be reduced. Besides, with the reduction in face width, it is possible to minimize the size, in the axial direction, of the engine output takeout device.

In addition, because the idler gear can be coaxially and rotatably supported on the first crankshaft via the bearing and the first crank shaft and the idler gear can rotate in substantial, constant synchronism, no friction occurs in the bearing, so that the bearing can have an increased operating life.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

A preferred embodiment of the present invention will be described in detail below, by way of example only, with reference to the accompanying drawings, in which.

DETAILED DESCRIPTION OF THE PREFERRED EMBODIMENTS

Figure 1:
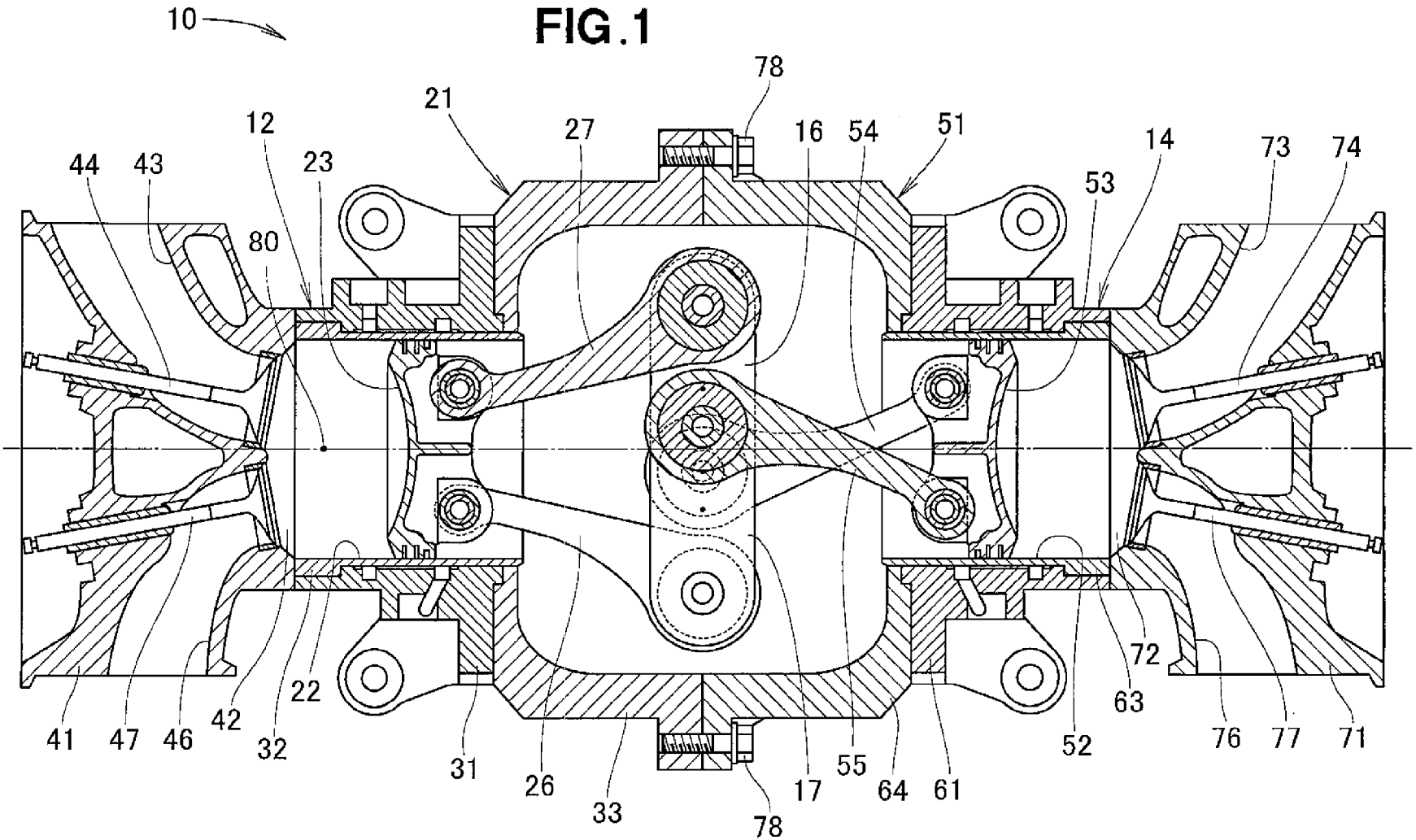
FIG. 1 is a sectional view of an engine according to the present invention.

FIG. 1 is a sectional view of an engine according to the present invention. The engine 10 is, for example, of a horizontally-opposed-two-cylinder type, which includes left and right cylinder sections 12 and 14 and two (i.e., first and second) crankshafts 16 and 17 rotatably provided between the left and right cylinder sections 12 and 14.

The left cylinder section 12 includes: a left cylinder block 21; a first piston 23 freely movably inserted in a left cylinder bore 22 formed in the left cylinder block 21; first and third connecting rods 26 and 28 (FIG. 2) connected to the first piston 23 and crankshaft 27, respectively; and a second connecting rod 27 connected to the first piston 23 and crankshaft 16.

The left cylinder block 21 includes a left cylinder body 31 and a left cylindrical sleeve 32 fitted inside the left cylinder body 31 and having the left cylinder bore 22 formed therein, and a left crankcase 33 is attached to the left cylinder body 31.

In FIG. 1, reference numeral 41 indicates a left cylinder head attached to a side of the left cylinder block 21 via a head gasket (not shown), 42 a combustion chamber, 43 an intake port, 44 an intake valve, 46 an exhaust valve, and 47 an exhaust valve.

The right cylinder section 14 is generally identical in fundamental construction to the aforementioned left cylinder block 21, and it includes: a right cylinder block 51; a right cylinder bore 52; a second piston 53 freely movably inserted in the right cylinder bore 52 formed in the left cylinder block 21; fourth and sixth connecting rods 54 and 56 (FIG. 2) connected to the second piston 53 and first crankshaft 16, respectively; and a fifth connecting rod 55 connected to the second piston 53 and second crankshaft 17.

The right cylinder block 51 includes a right cylinder body 61 and a right cylindrical sleeve 63, and a right crankcase 64 is attached to the right cylinder body 61. In FIG. 1, reference numeral 71 indicates a right cylinder head, 72 a combustion chamber, 73 an intake port, 74 an intake valve, 76 an exhaust valve, and 77 an exhaust valve. 78 indicates a plurality of bolts interconnecting the left crankcase 33 and right crankcase 64, and 80 indicates a cylinder axis passing centrally through the left and right cylinder bores 22 and 52.

Figure 2:
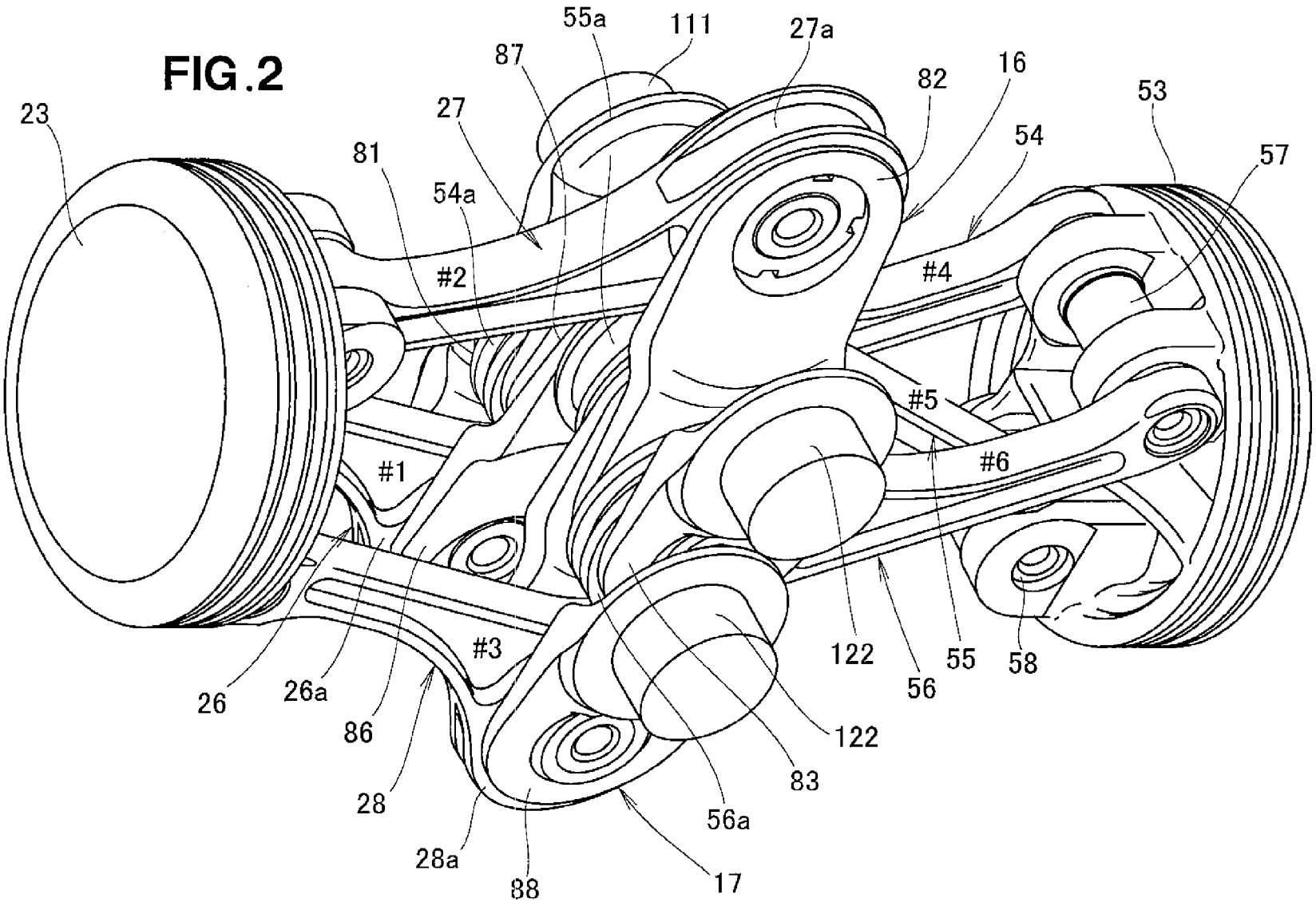
FIG. 2 is a perspective view showing an assembly of crankshafts connecting rods and pistons.

FIG. 2 is a perspective view showing an assembly of the crankshafts, connecting rods and pistons. In the assembly, the fourth connecting rod 54 (indicated by "#4" in the figure) is connected at its great-size end portion 54*a* to a first crankpin 81 of the first crankshaft 16, the second connecting rod 27 (indicated by "#2" in the figure) is connected at its great-size end portion 27*a* to a second crankpin 82 of the first crankshaft 16, and the sixth connecting rod 56 (indicated by "#6" in the figure) is connected at its great-size end portion 56*a* to a third crankpin 83 of the first crankshaft 16. Further, the first connecting rod 26 (indicated by "#1" in the figure) is connected at its great-size end portion 26*a* to a first crankpin 86 of the second crankshaft 17, the fifth connecting rod 55 indicated by "#5" in the figure) is connected at its great-size end portion 55*a* to a second crankpin 87 of the second crankshaft 17, the third connecting rod 28 (indicated by "#3" in the figure) is connected at its great-size end portion 28*a* to a third crankpin 88 of the first crankshaft 16. Furthermore, the first connecting rod 26, second connecting rod 27 and third connecting rod 28 are connected at their respective small-size end portions to the first piston 23 via piston pins (not shown), and the fourth connecting rod 54, fifth connecting rod 55 and sixth connecting rod 56 are connected at their respective small-size end portions to the second piston 53 via piston pins 57 and 58.

Namely, the first piston 23 is supported by three connecting rods, i.e. first, second and third connecting rods 26, 27 and 28 while the second piston 53 is supported by the other three connecting rods, i.e. fourth, fifth and sixth connecting rods 54, 55 and 56, so that the first and second pistons 23 and 53 can be supported in a stable manner.

Figure 3:
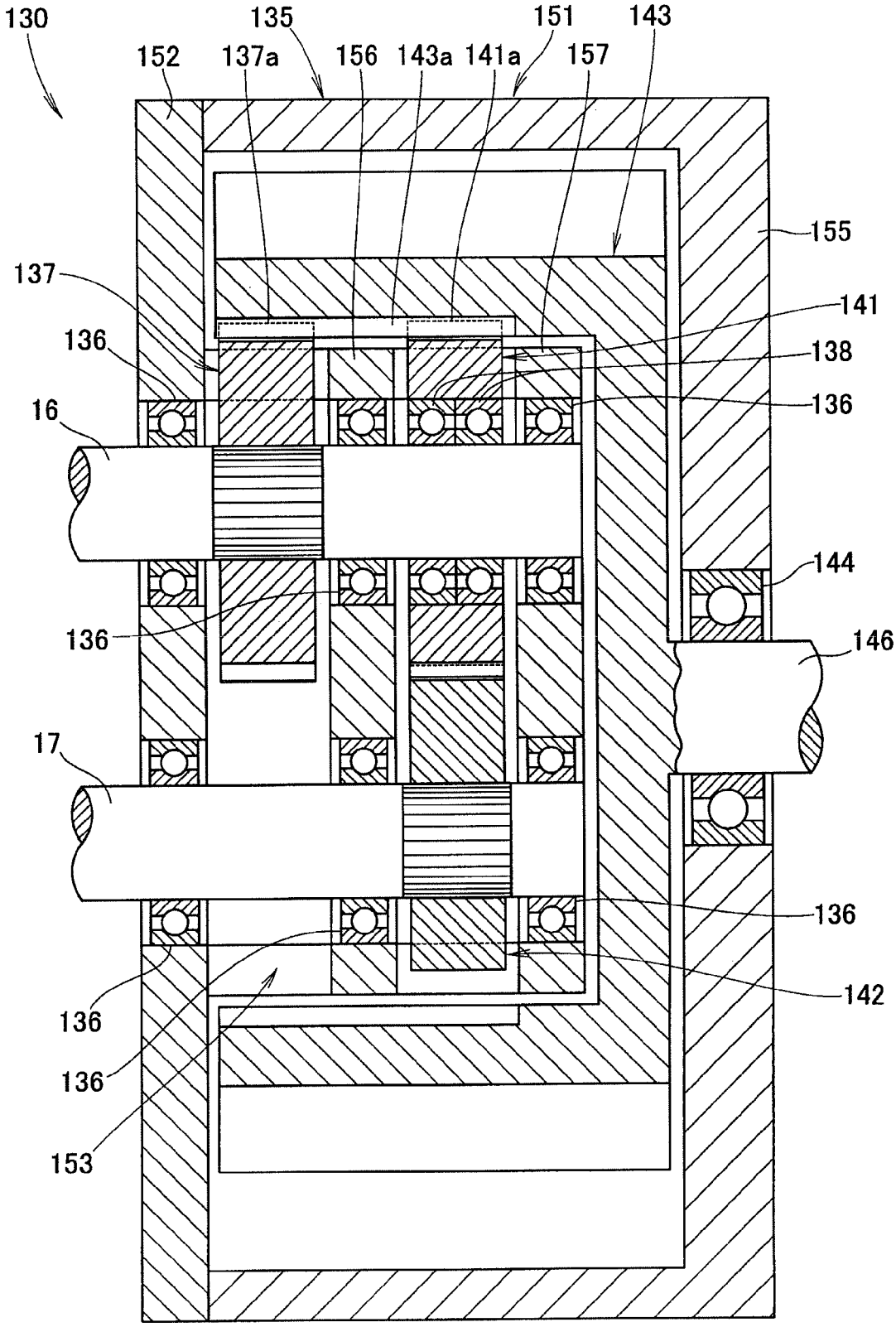
FIG. 3 is a sectional view of a engine output device according to a first embodiment of the present invention.

FIG. 3 is a sectional view of the engine output takeout device according to a first embodiment of the present invention. As shown in the figure, the engine output takeout device 130 includes: a gear case 135 in which are inserted respective one end portions of the crank shafts 16 and 17 of the engine 10 (see FIG. 1); a plurality of bearings 136 mounted in the gear case 35 for rotatably supporting the end portions of the crank shafts 16 and 17; a first crank gear 137 spline-coupled to the first crankshaft 16; an idler gear 141 rotatably mounted on the crankshaft 16 via bearings 138; a second gear 142 spline-coupled to the second crankshaft 17 and meshing with the idler gear 141; a ring gear 143 meshing the first crank gear 137 and idler gear 141; and an output shaft 146 rotatably supported on the gear case 135 via a bearing 144 and provided integrally with the ring gear 143.

The gear case 135 includes a case body 151 in the form of a bottomed cylinder, a case cover 152 closing the opening of the case body 151, and an inner case 153 attached to the case cover 152. The output shaft 146 is supported by the bottom 155 of the case body 151 via the bearing 144, and the first and second crack shafts 16 and 17 are supported by the case cover 152 and inner case 153 via the bearings 136. Reference numerals 156 and 157 represent an intermediate support section and an end support section, respectively.

One of the teeth 137*a* of the first crank gear 137 meshes with one of the inner teeth 143*a* of the ring gear 143, and one of the teeth 141*a* of the idler gear 141 meshes with one of the inner teeth 143*a* of the ring gear 143 with which the first crank gear 137 meshes.

Figure 4A:
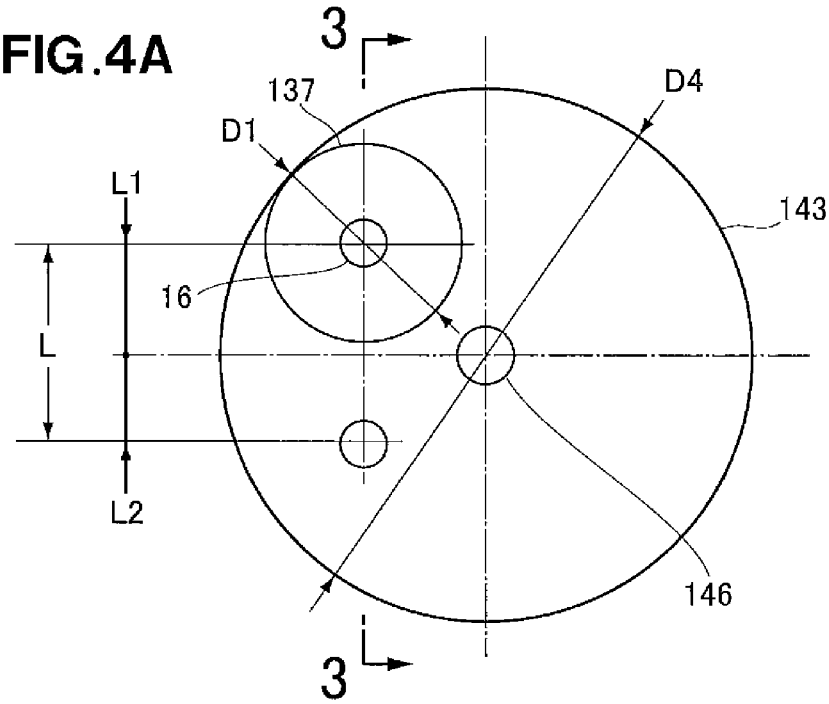
FIGS. 4A and 4B are views further explanatory of the engine output device according to the first embodiment of the present invention.
Figure 4B:
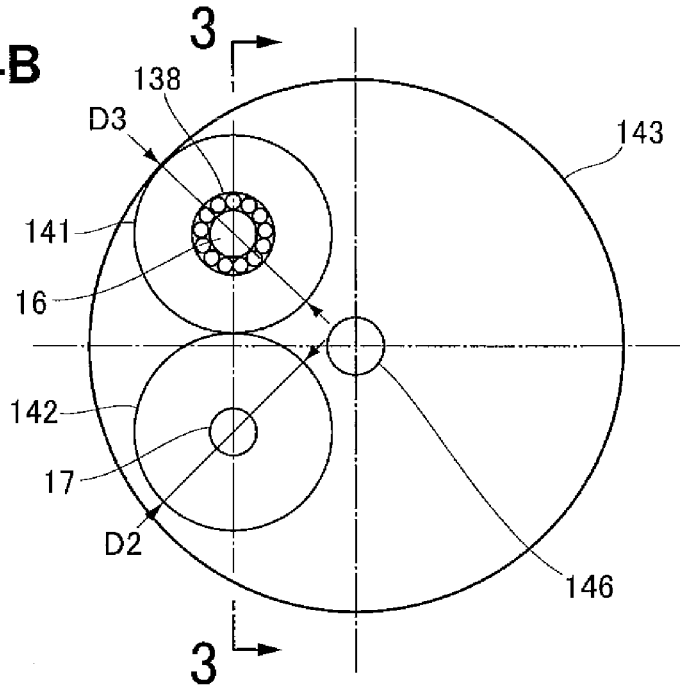

FIGS. 4A and 4B are views further explanatory of the engine output takeout device 130. More specifically, FIG. 4A schematically shows how the first crank gear 137 and the ring gear 143 mesh with each other in the engine output takeout device 130. The first crank gear 137 is mounted on the first crankshaft 16 to mesh with the ring gear 143.

The first crank gear 137 has a pitch diameter D1 smaller than a pitch diameter D4 of the ring gear 143 (D1<D4). Further, the first and second crankshafts 16 and 17 are spaced apart from each other by a distance (i.e., inter-crankshaft distance) L, the first crankshaft 16 and output shaft 146 are spaced apart from each other by a distance L1, and the second crankshaft 17 and output shaft 146 are spaced apart from each other by a distance L2. Relationship among these distances is set to satisfy the conditions of L=L1+L2 and L1>L2.

FIG. 4B shows how the second crank gear 142, idler gear 141 and ring gear 143 mesh with one another. The second crank gear 142 is mounted on the second crankshaft 17 to mesh with the idler gear 141.

The idler gear 141 is mounted on the first crankshaft 16 via the bearings 138 and mesh with the ring gear 143. Position of meshing between the idler gear 141 and the ring gear 143 agrees, in a circumferential direction, with a position of meshing between the first crank gear 137 and the ring gear 143 as shown in FIG. 4A.

The second crank gear 142 and idler gear 141 have pitch diameters D2 and D3, respectively, and relationship among the pitch diameters is set to satisfy the conditions of D1=D2=D3<D4 and L=D2/2+D3/2.

Figure 5:
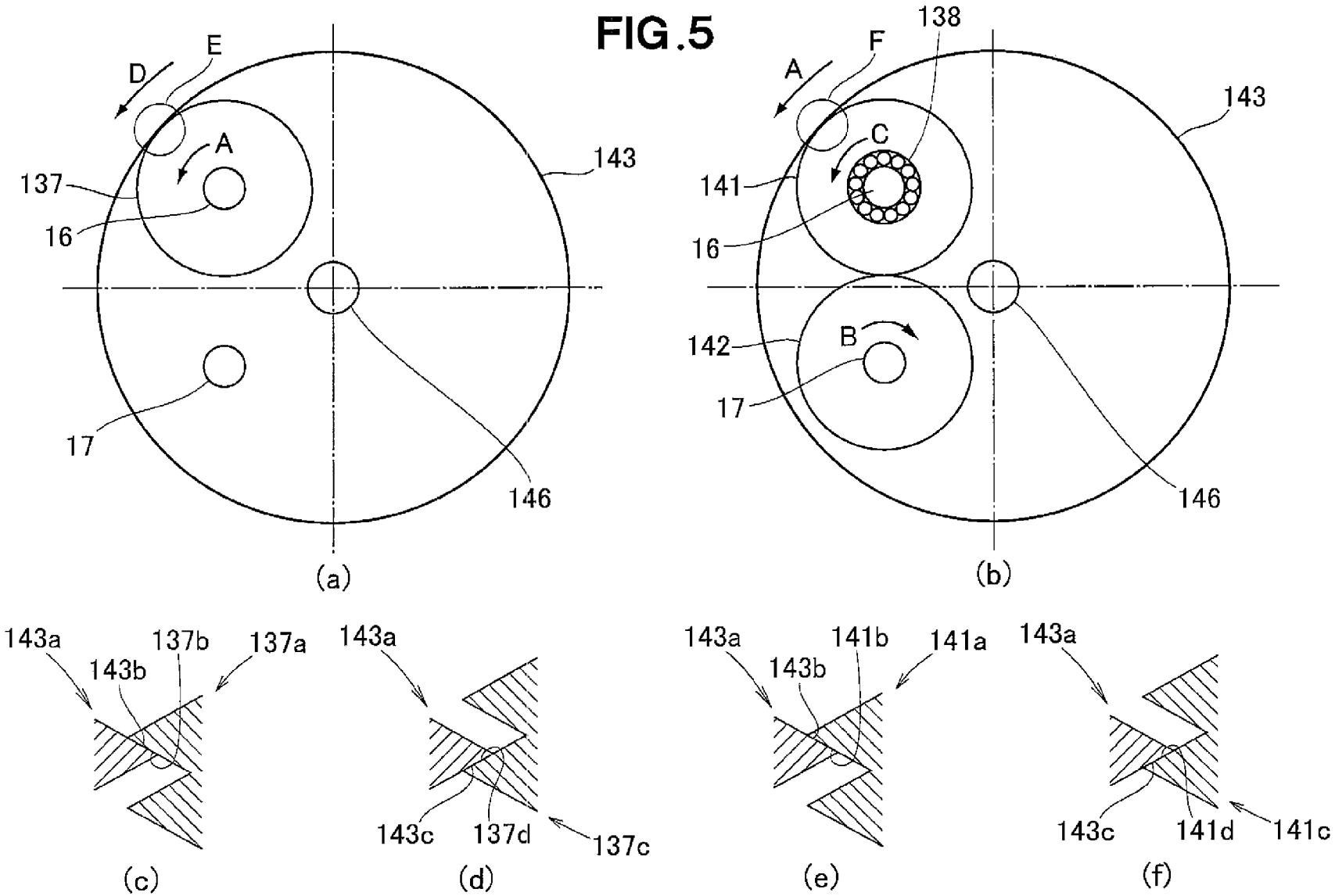
FIG. 5 is a view explanatory of behavior of the engine output device according to the first embodiment of the present invention.

FIG. 5 is a view explanatory of behavior of the engine output takeout device 130, where (a) schematically shows how the first crank gear 137 and ring gear 143 mesh with each other and (b) schematically shows how the second crank gear 142, the idler crank gear 141 and ring gear 143 mesh with each other.

Let it be assumed here that, in (a) and (b) of FIG. 5, the first crank gear 137 and ring gear 143 rotate in directions of arrows A and D, respectively, and the second crank gear 142 and idler gear 141 rotate in directions of arrows B and C, respectively.

In the expansion stroke of the engine and at a position of meshing E between the first crank gear 137 and ring gear 143, as shown in (c) of FIG. 5, the first crank gear 137 has a smaller moment of inertia than the ring gear 143 and thus is easier to rotate than the ring gear 143, and a tooth surface 137*b* of one of the teeth 137*a* of the first crank gear 137 contacts a tooth surface 143*b* of one of the inner teeth 143*a* of the ring gear 143. Namely, in this case, the first crank gear 137 functions as a driving gear, while the ring gear 143 functions as a driven gear.

In the expansion stroke of the engine and at a position of meshing F (see (b)) between the idler gear 141 and ring gear 143, as shown in (e) of FIG. 5, the idler gear 141 has a smaller moment of inertia than the ring gear 143 and thus is easier to rotate than the ring gear 143, and a tooth surface 141*b* of one of the teeth 141*a* of the idler gear 141 contacts the tooth surface 143*b* of one of the inner teeth 143*a* of the ring gear 143. Namely, in this case, the idler gear 141 functions as a driving gear, while the ring gear 143 functions as a driven gear.

In the compression stroke of the engine and at the position of meshing E (see (a) of FIG. 5) between the first crank gear 137 and ring gear 143, as shown in (d) of FIG. 5, the ring gear 143 keeps rotating because it has a greater moment of inertia than the first crank gear 137, and a tooth surface 143*c* of one of the inner teeth 143*a* of the ring gear 143 contacts a tooth surface 137*d* of one of the teeth 137*c* of the first crank gear 137. Namely, in this case, the ring gear 143 functions as a driving gear, while the first crank gear 137 functions as a driven gear.

In the compression stroke of the engine and at the position of meshing F (see (a) of FIG. 5) between the idler gear 141 and ring gear 143, as shown in (f) of FIG. 5, the ring gear 143 keeps rotating because it has a greater moment of inertia than the idler gear 141, and the tooth surface 143*c* of one of the inner teeth 143*a* of the ring gear 143 contacts a tooth surface 141*d* of one of the teeth 141*c* of the idler gear 141. Namely, in this case, the ring gear 143 functions as a driving gear, while the idler gear 141 functions as a driven gear.

As seen from (a)-(f) of FIG. 5, the first crank gear 137 and the idler gear 141 mesh with a same tooth of the ring gear 143 at any given time regardless of the current stroke (i.e., expansion or compression stroke) of the engine; thus, the first crank gear 137 and the idler gear 141 rotate in constant synchronism with each other. Therefore, the first and second pistons 23 and 53 do not incline, so that it is possible to prevent generation of unwanted slap sound, abrasion, etc. of the first and second pistons 23 and 53 and left and right cylinder bores 22 and 52.

Figure 6:
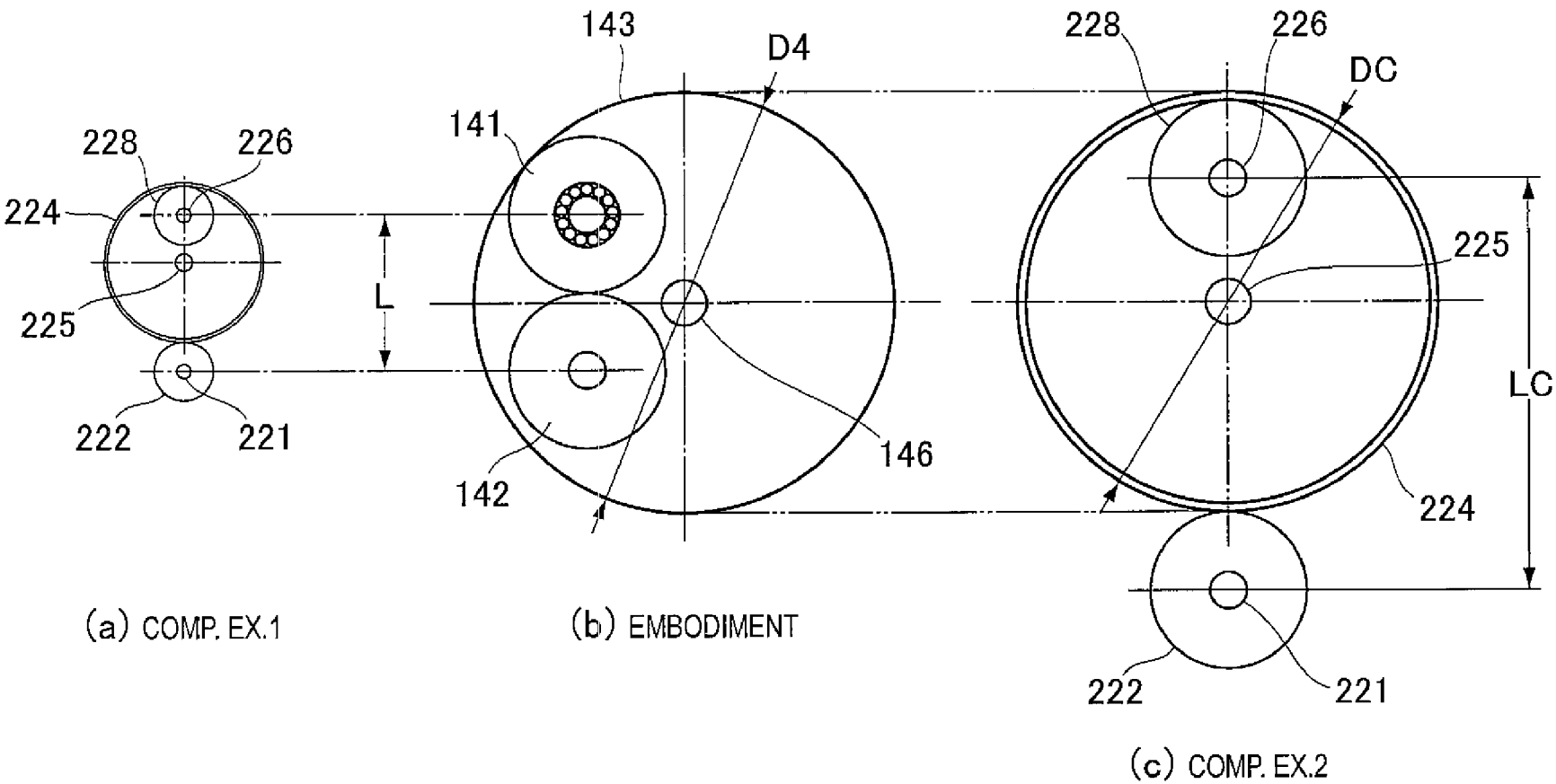
FIG. 6 is a view showing comparisons between the engine output takeout device according to the embodiment of the present invention and comparative examples.
Figure 9:
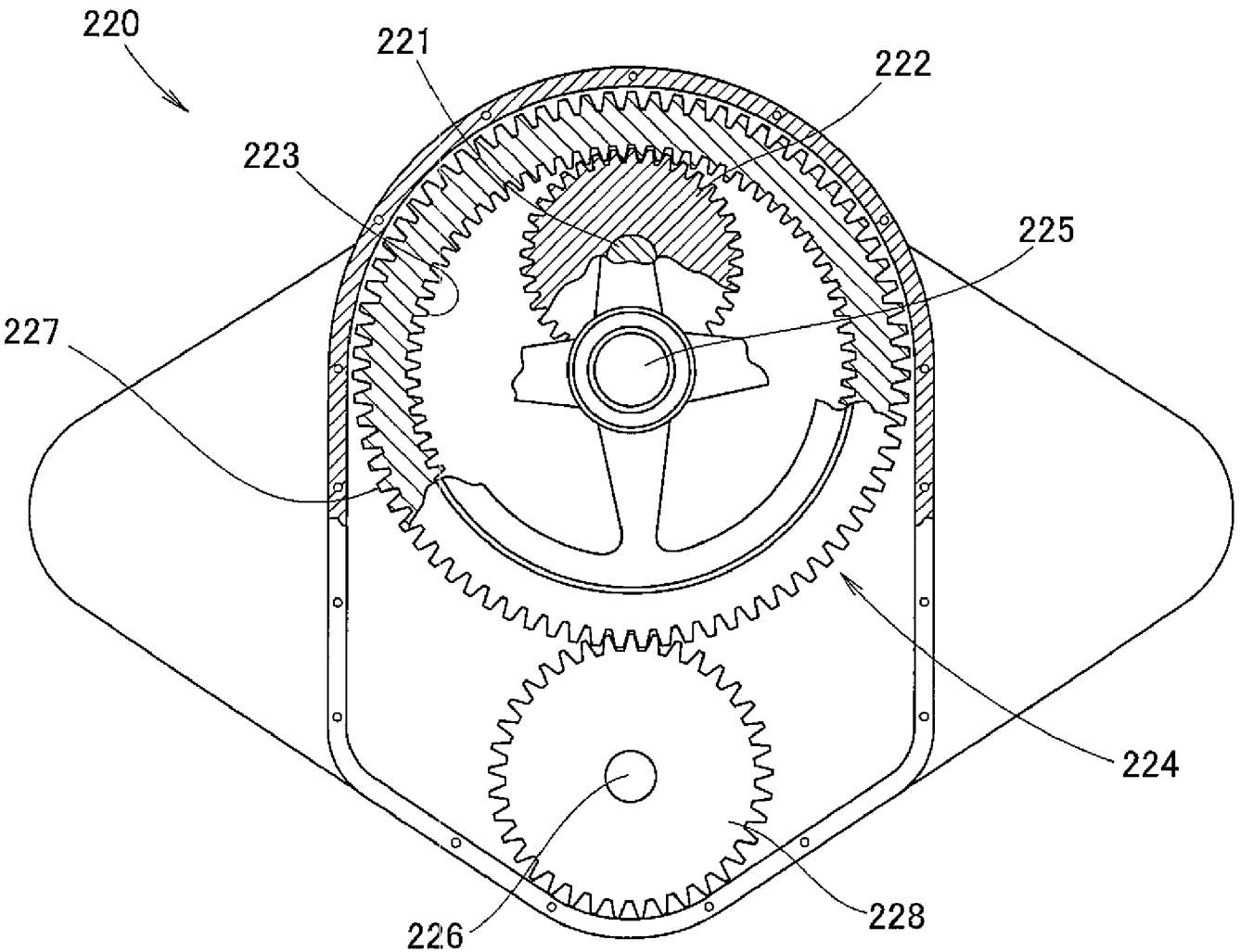
FIG.9 (PRIOR ART)
FIG. 9 is a partly-sectional side view of another conventionally-known engine output takeout device.
Figure 10:
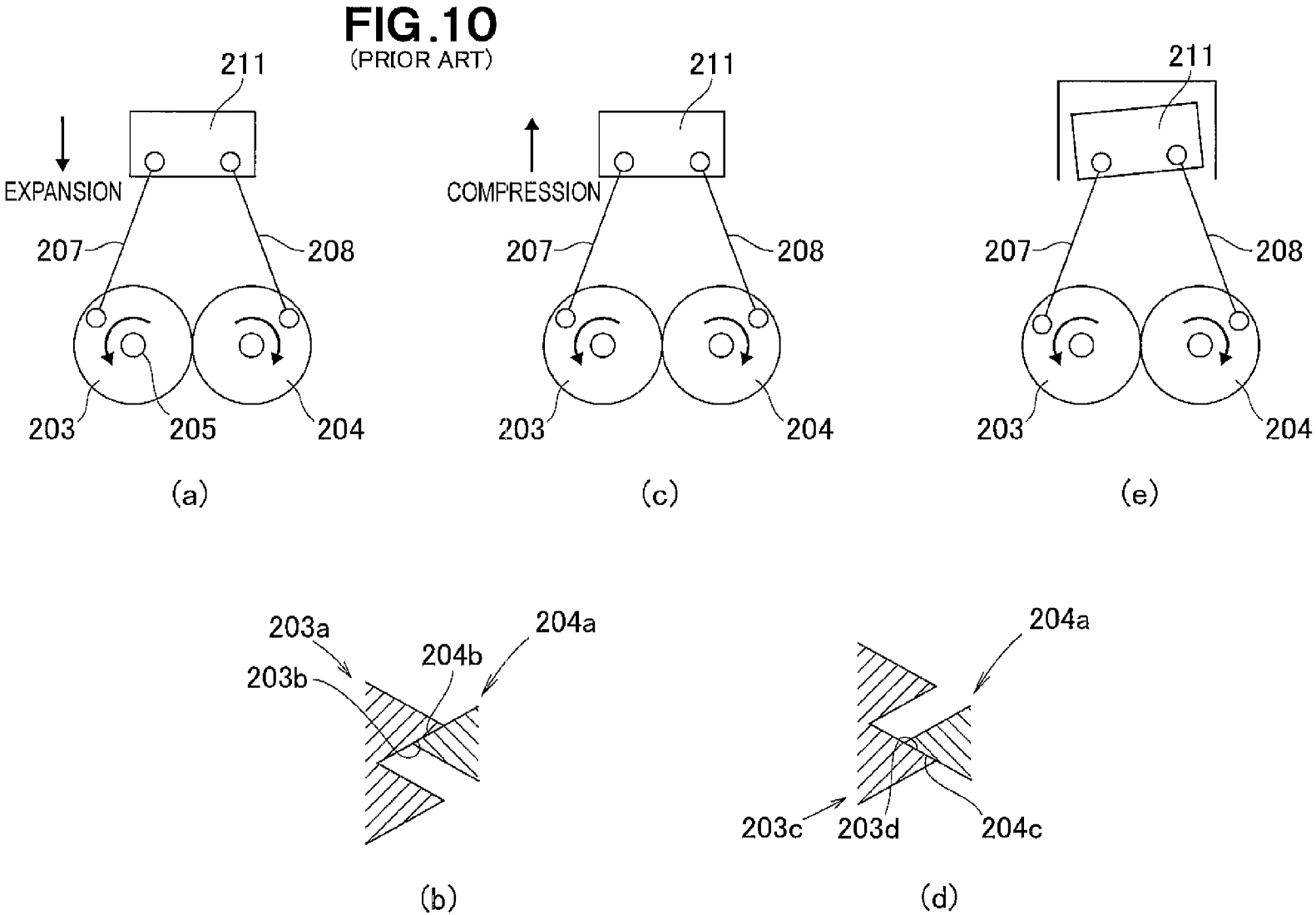
FIG.10 (PRIOR ART)
FIG. 10 is a view explanatory of behavior of the engine output takeout device of FIG. 8.
Figure 11:
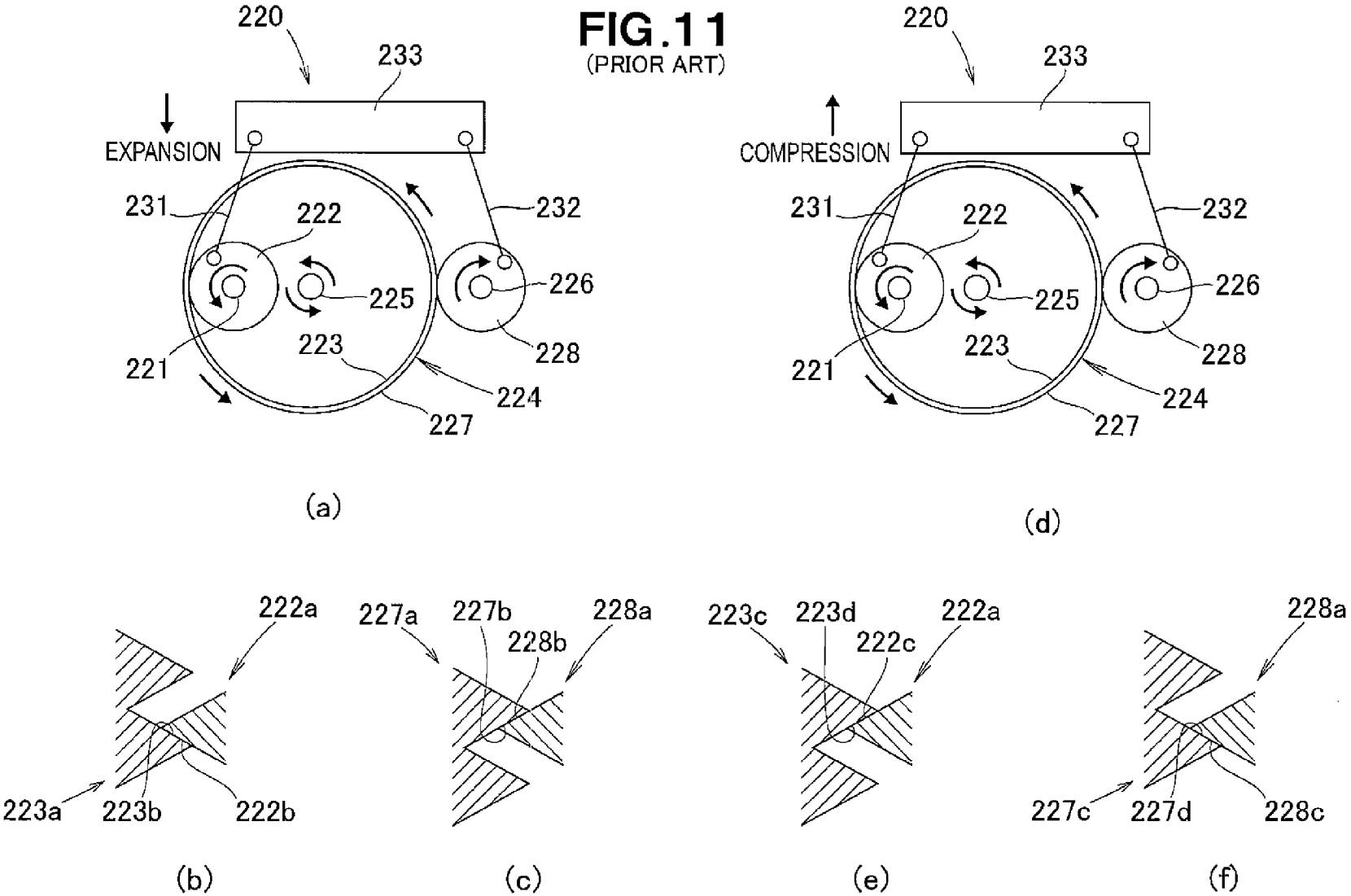
FIG. 11 (PRIOR ART)
FIG. 11 is a view explanatory of behavior of the engine output takeout device of FIG. 9.

FIG. 6 is a view showing comparisons between the instant embodiment of the engine output takeout device 130 of the present invention and comparative examples. (a) of FIG. 6 shows comparative example 1 that particularly indicates the inter-crankshaft distance of the conventionally-known engine output takeout device discussed above in relation to FIG. 9, and if the inter-crankshaft distance of this comparative example is set to equal the inter-crankshaft distance L of the instant embodiment, the output gear 224 of comparative example 1 will have a smaller size than the ring gear 143 of the instant embodiment. Thus, the output gear 224 of comparative example 1 has a smaller moment of inertia, so that provision of a flywheel is required to minimize rotational fluctuation of the engine.

(b) of FIG. 6 shows comparative example 2 that particularly indicates the pitch diameter DC of the output gear 224 of the conventionally-known engine output takeout device discussed above in relation to FIG. 9), and if the pitch diameter DC of the output gear 224 in this comparative example is set to equal the pitch diameter D4 of the ring gear 143 of the instant embodiment, the inter-crankshaft LC of comparative example 2 will be greater than the inter-crankshaft distance L of the instant embodiment, so that the engine itself will have an increased size.

Figure 7B:
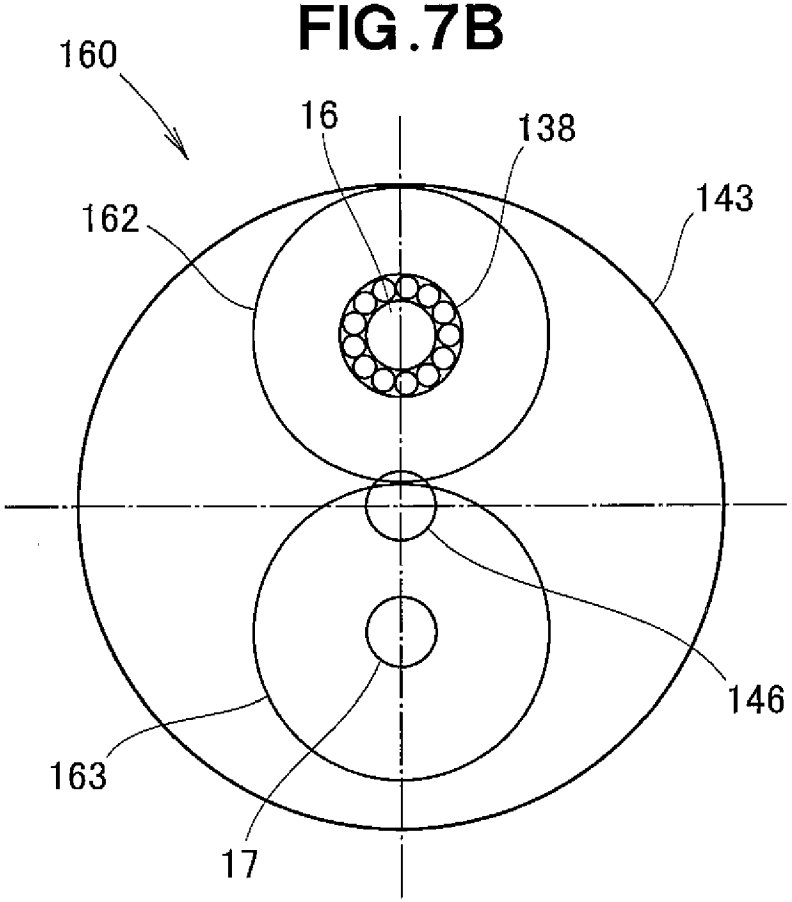
FIGS. 7A and 7B are views schematically showing an engine output takeout device according to another or second embodiment of the present invention.
Figure 7A:
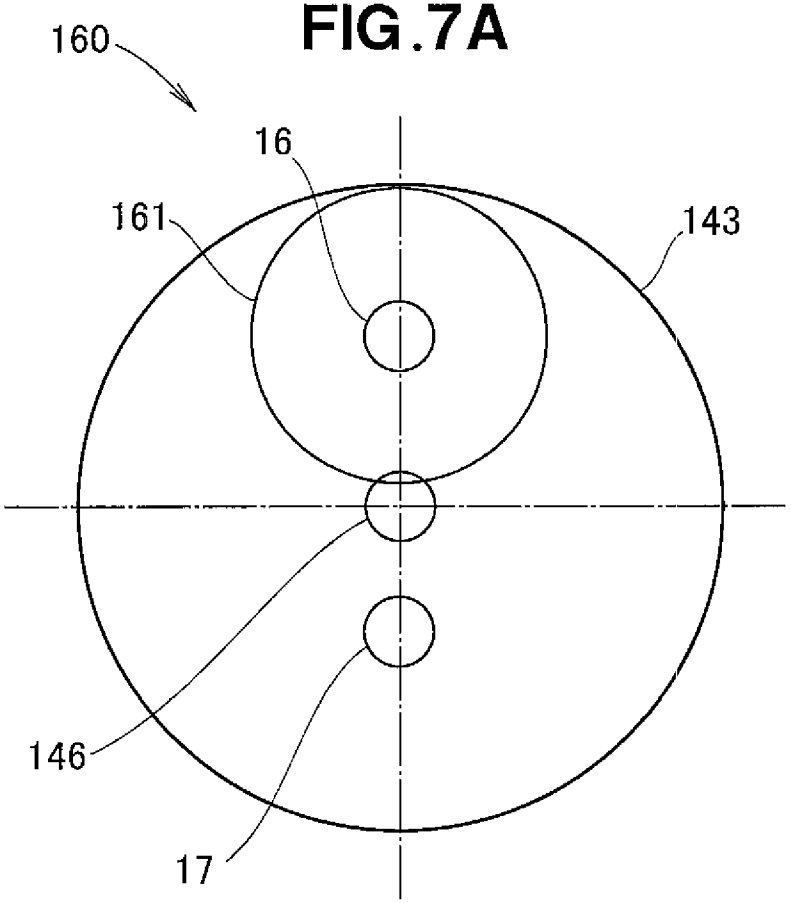
Figure 8:
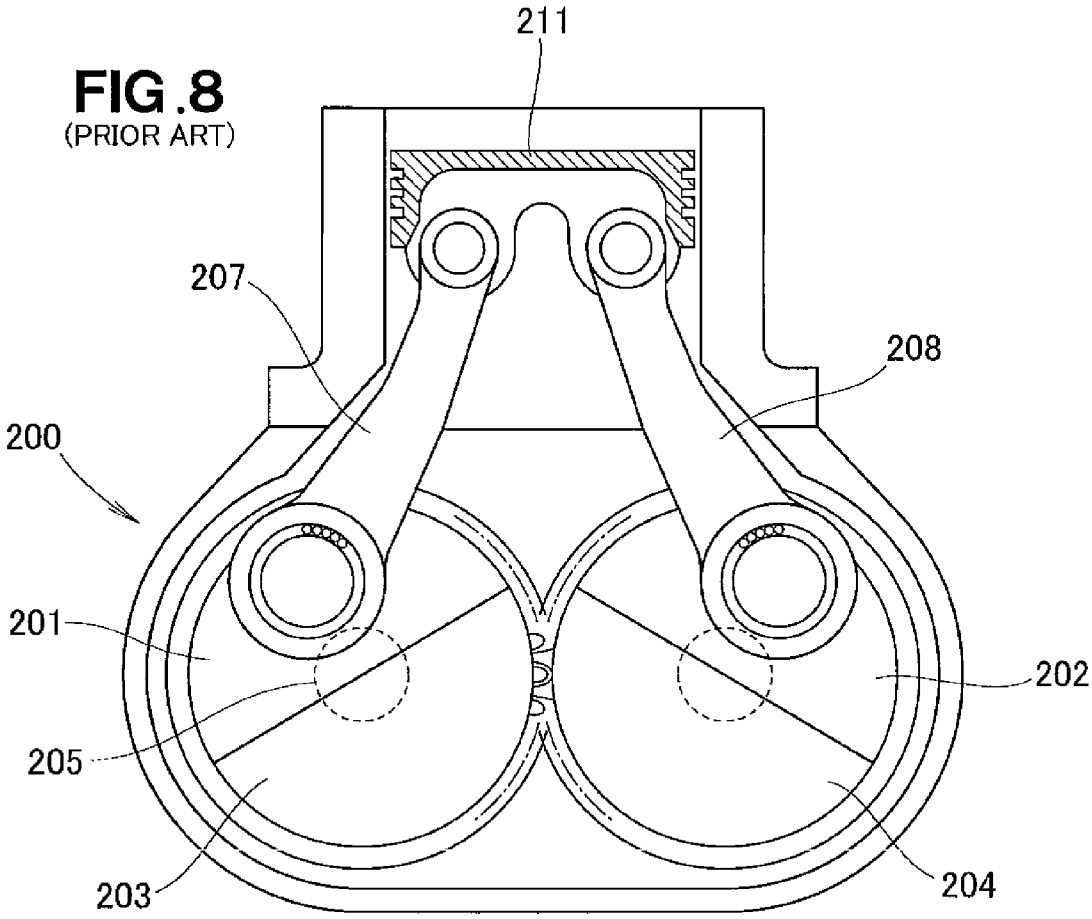
FIG.8 (PRIOR ART)
FIG. 8 is a partly-sectional side view of a conventionally-known engine output takeout device.

FIGS. 7A and 7B are views schematically showing an engine output takeout device according to another or second embodiment of the present invention. In FIG. 7, the same elements as in FIGS. 3 and 4 are indicated by the same reference numerals and will not be described here to avoid unnecessary duplication.

The engine output takeout device 160 shown in FIG. 7A includes an output shaft 146 provided between the first and second crankshafts 16 and 17, and a first crank gear 161 attached to the first crankshaft 16 meshes with the ring gear 143.

Further, in the engine output takeout device 160, as shown in FIG. 7B, an idler gear 162 is rotatably mounted on the first crankshaft 16 via the bearings 138 and meshes with the ring gear 143, and a second crank gear 163 is rotatably mounted on the second shaft 17 and meshes with the idler gear 162.

With the output shaft 147 disposed on a straight line interconnecting the first and second crankshafts 16 and 17 as shown in FIGS. 7A and 7B, the second embodiment can increase the pitch diameters of the first and second crank gears 162 and 163 and reduce the speed reduction ratio.

As having been described above with primary reference to FIGS. 1, 3 and 4, the engine output takeout device 130, which is designed to take out engine output from the first and second crankshafts 16 and 17 disposed in parallel to each other in the engine 10 and disposed in parallel to each other, includes: the first crank gear 137 mounted on the first crankshaft 16; the second crank gear 142 mounted on the second crankshaft 17; the ring gear 143 disposed to surround the first and second crank gears 137 and 142 and having inner teeth meshing with the first crank gear 137; and the idler gear 141 rotatably mounted on the first crankshaft 16 via the bearings 138 and meshing at one position thereof with the second crank gear 142 and at another position thereof with the inner teeth of the ring gear 143. Namely, the first crank gear 137 and idler gear 141 mesh with a same inner tooth of the ring gear 143, and thus, even when deformation or flower pedal oscillation (i.e., oscillation accompanied by deformation of a flower pedal shape) occurs in the ring gear 143 during high-load operation and high-speed rotation of the crank gears, there can constantly be achieved rotation synchronism between the first crank gear 137 and the idler gear 141, i.e. between the first crank gear 137 and the second gear 142. As a result, the present invention can reliably prevent unwanted inclination of the first and second pistons 23 and 53 and thus can minimize generation of slap sound and abrasion of the first and second pistons 23 and 53 and left and right cylinder bores 22 and 52.

Further, because the first crank gear 137, second crank gear 142 and idler gear 141 are disposed inside the ring gear 143, the diameter of the ring gear 143 can be set greater than that in the conventionally-known counterparts. Therefore, even where the speed reduction ratio is to be increased, the modules of the individual gears need not be increased, so that it is possible to prevent an increase in abrasive wear. Furthermore, because it is possible to increase the moment of inertia of the ring gear 143, the present invention can eliminate a need for provision of a flywheel and thereby reduce the number of necessary component parts and hence the necessary cost. Furthermore, by increasing the size of the ring gear 143, the present invention can reduce the tooth surface load and thereby reduce the face width of the ring gear 143.

On the other hand, the tip diameter of the inner teeth of the ring gear 143 can be reduced within a particular range as long as the first crank gear 137, second crank gear and idler gear 141 can be disposed inside the ring gear 143, and thus, the engine output takeout device 130 can be reduced in size.

Furthermore, the present invention can maintain constant synchronism between the first and second crank gears 137 and 142 by causing these gears to mesh with the same teeth of the ring gear 143, rather than by increasing the rigidity of the ring gear 143; in this way, the ring gear 143 can be reduced in weight. Besides, with the reduction in face width, it is possible to minimize the size, in the axial direction, of the engine output takeout device 130.

Moreover, because the idler gear 141 can be coaxially and rotatably supported on the crankshaft 16 via the bearings 138 and the first crank shaft 16 and the idler gear 141 rotate in substantial synchronism, no friction occurs in the bearings 138, so that the bearings 138 can have an increased operating life.

The engine output takeout device of the present invention is particularly suited for use in parallel-crank type engines.

Obviously, various minor changes and modifications of the present invention are possible in light of the above teaching. It is therefore to be understood that within the scope of the appended claims the invention may be practice otherwise than as specifically described.

What is claimed is:

1. An engine output takeout device for taking out engine output from first and second crankshafts disposed in parallel to each other in an engine, said engine output takeout device comprising:

a first crank gear mounted on the first crankshaft;

a second crank gear mounted on the second crankshaft;

a ring gear disposed to surround the first and second crank gears and having inner teeth meshing with said first crank gear; and an idler gear rotatably mounted coaxially on the first crankshaft via a bearing and meshing at one position thereof with said second crank gear and at another position thereof with the inner teeth of said ring gear, said first crank gear and said idler gear both meshing with a same inner tooth of said ring gear at any given time.

* * * * *